US005196211A

United States Patent [19]

Goossens

[11] Patent Number: 5,196,211

[45] Date of Patent: Mar. 23, 1993

[54] APPARATUS FOR SPINNING OF CORE/SHEATH FIBERS

[75] Inventor: Gunter Goossens, Trin, Switzerland

[73] Assignee: EMS-Inventa AG, Tokyo, Japan

[21] Appl. No.: 869,890

[22] Filed: Apr. 14, 1992

Related U.S. Application Data

[63] Continuation of Ser. No. 555,069, Jul. 18, 1990, abandoned.

[30] Foreign Application Priority Data

Jul. 19, 1989 [DE] Fed. Rep. of Germany ..... 3923923
Aug. 30, 1989 [DE] Fed. Rep. of Germany ..... 3928740

[51] Int. Cl.[5] ..... B29C 47/04

[52] U.S. Cl. ..... 425/131.5; 264/171; 425/133.1; 425/462

[58] Field of Search ..... 264/171; 425/130, 131.1, 425/131.5, 133.1, 192 S, 382.2, 462, 463

[56] References Cited

U.S. PATENT DOCUMENTS

| | | | |
|---|---|---|---|
| 3,692,423 | 9/1972 | Okamoto et al. | 425/131.5 |
| 3,760,052 | 9/1973 | Fukuma et al. | 425/131.5 |
| 3,849,044 | 11/1974 | Ando et al. | 425/131.5 |
| 4,052,146 | 10/1977 | Sternberg | 425/131.5 |

FOREIGN PATENT DOCUMENTS

| | | | |
|---|---|---|---|
| 45-27537 | 9/1970 | Japan | 425/131.5 |
| 46-41403 | 12/1971 | Japan | 425/131.5 |
| 57-47942 | 3/1982 | Japan | 425/131.5 |
| 274306 | 9/1970 | U.S.S.R. | 425/131.5 |

*Primary Examiner*—Jay H. Woo
*Assistant Examiner*—James P. Mackey
*Attorney, Agent, or Firm*—Jordan B. Bierman

[57] ABSTRACT

A pack for spinning core/sheath fibers from a plurality of fiber-forming materials including a distributor, a spinneret plate, and a separating plate therebetween. The distributor has a first conduit adapted to convey one of the first materials in a stream in a downstream direction, and a second conduit adapted to convey another material in a second stream in the same direction. The separating plate includes a core cavity, an annulus surrounding it, a sheath channel fluidly connecting the first conduit and the annulus, and a core channel fluidly connecting the second conduit and the cavity. The spinneret plate includes an exit channel with a die capillary at its downstream end fluidly connected to the annulus and the core cavity at its upstream end. The exit channel has an entry with diameter at least equal to the annular diameter, the entry being located at or adjacent the upstream end. As a result, the first stream surounds the second stream and both are extruded through the die capillary to form the fiber.

7 Claims, 3 Drawing Sheets

FIG. 10
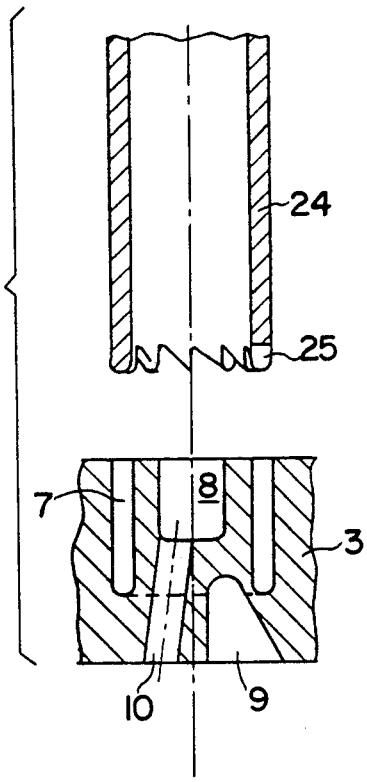
FIG. 11
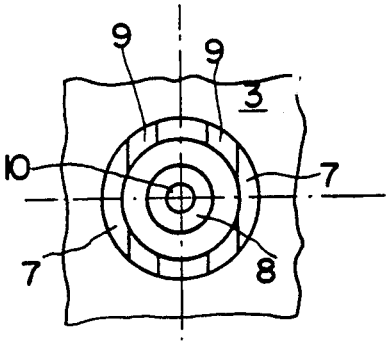
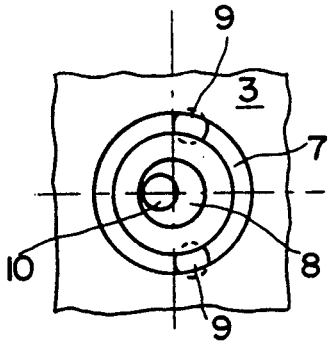
FIG. 12
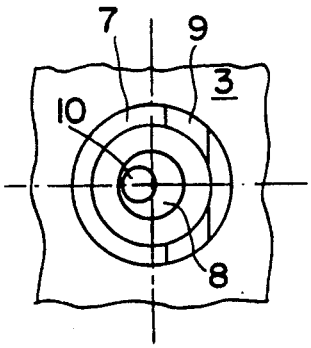
FIG. 13
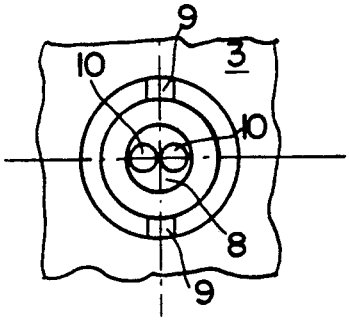
FIG. 14

APPARATUS FOR SPINNING OF CORE/SHEATH FIBERS

This application is a continuation of application Ser. No. 07/555069, filed Jul. 18, 1990, now abandoned.

This Application claims the benefit of the priority of German Application 39 23 923.3, filed Jul. 19, 1989 and German Application 39 28 740.8, filed Aug. 30, 1989.

The present invention is directed to an apparatus for the spinning of core/sheath fibers from various fiber-forming materials. It is particularly characterized by permitting a high concentration of fibers in a small area.

BACKGROUND OF THE INVENTION

Core/sheath fibers and yarns are well known in the existing prior art. They comprise at least two fiber-forming materials, usually polymers of different types and/or of different properties. At least one of the polymers forms the core of the finished fiber, while at least one other forms the sheath. It is a goal of the prior art to produce perfectly concentric structures, which constitute superior products.

Such fibers have substantial advantages. For example, by appropriately selecting the materials of which the core and sheath are made, the overall mechanical properties of the fiber may be varied widely. One set of properties is found in the sheath, while another set of properties results from the core.

For example, flame resistance can be imparted to the core by the use of certain additives; at the same time, the sheath can be selected for its strength or load carrying properties. Similarly, complementary fibers of this type can be used to prepare filter materials. Also, contrasting properties can be provided where needed.

However, if thin fibers to be spun into yarn are desired, the previously known equipment for doing so was highly complex and awkward to use. Due to the separate supply lines necessary to bring the plurality of fiber-forming materials to each die capillary (of a plurality of die capillaries) in order to form filaments, the devices comprise a large number of complicated individual parts which are expensive to produce. Moreover, dismantling, cleaning, and servicing such devices becomes a delicate and time consuming operation.

In one previously known pack, the core polymer is introduced through tubular members which extend into the material forming the sheath. In order to accomplish this, the pack is made up of an upper distributor and a lower spinneret plate. The latter contains die capillaries having very small diameters. At the same time, the entry channels are relatively wide in order to receive the core tubes. The device is set up so that all of the tubes are as concentric as they can be to the entry channel of the die.

However, this device suffers from a number of serious disadvantages. Most importantly, it is not possible to get more than four die capillaries per square centimeter of die area. Furthermore, the delicate nature of the fine tubes presents serious problems in dismantling, cleaning, and reinstallation. A further serious problem resides in the positioning of the core tubes. Due to the fragility of these tubes, cleaning and servicing of the pack virtually precludes maintaining the core tubes precisely concentric during the life of the devices, without the necessity of extreme care and adjustment.

When the above maladjustment occurs, and core/sheath fibers having substantial differences in viscosity between the core and the sheath are being produced, a substantial proportion of the individual fibers will exhibit pronounced "kneeling" and have a tendency to stick to the spinneret plate, thus interrupting production. Kneeling occurs when two fiber-forming materials each occupy a certain proportion of the total cross section of flow and both are subjected to the same pressure conditions. This will force them into different flow behaviors resulting from the different viscosities; the lower viscosity component will flow more rapidly so that the cross section of its flow will be reduced.

After extrusion from the die capillary, the speeds of flow of the sheath and core are matched once again. Thus, the two materials again occupy the original proportion of the total cross section dictated by their respective volumes. However, due to normal inertia of the fiber, there is a delay before the matching of speeds occurs. Therefore, the low viscosity component is still moving faster than the high viscosity component after the fiber passes through the die orifice. In such a case, if the components are not precisely concentric, the fiber will kneel as a result.

The problem of precisely centering the various channels with respect to each other is a serious one. There are many factors which cause unpredictable variations, even after the devices have been manufactured. Obviously, there are the ever-present unavoidable production tolerances, both as to the location of the centers of the channels and the positions of the receiving bores for the locating pins on the elements of packs.

Moreover, even if the pack is properly set when new, it can easily become misaligned due to the necessary servicing during its life. The necessary disassembly, cleaning, reassembly, adjustment, etc. all provide opportunities for misalignment. As a result, it becomes difficult (and hence expensive) to provide and maintain devices which will produce fine fibers in core/sheath form.

If the production cost for such fibers are to remain within economically acceptable limits, extremely close tolerances simply cannot be used. Since a large number of die capillaries are necessary, allowance must be made for the substantial portion which will exhibit the variations due to tolerance and handling. Extensive spinning tests have corroborated this.

One attempted solution has been to guide the core tubes into the channel openings by suitable elements. Those which are star-shaped have frequently been used. However, it is not possible to obtain a high die capillary density and the costs and complications of such devices (particularly during cleaning and reassembly) render them unsatisfactory.

In U.S. Pat. No. 4,052,146, there is disclosed a device wherein the annular cavities (which form the sheath) are offset vertically from each other so that they can be partially "interleaved". The annular channels which form the sheath are flat and arranged around the extension of the die channels. However, the external diameters thereof limit the capillary density which can be obtained, even if the annular channels are offset in height and overlapping. Even with this arrangement, however, the density of the die capillaries achieved is still only less than three per square centimeter.

In European Application 284,784, the core tubes are replaced by lamellas which are fixed together and traverse entire rows of the inlet openings. This assists in alleviating some of the foregoing problems; however, misalignment of the core-forming and sheath-forming elements still occurs because of unavoidable manufacturing tolerances. The cylindrical side channels require greater volume than the usual spinning channels and the separate polymer feeds may result in differences in the thickness of the sheath. This, of course, will produce the kneeling effect previously described herein. Moreover, all of the known devices, because of the high precision necessary in their manufacture, are relatively expensive.

BRIEF DESCRIPTION OF THE PRESENT INVENTION

It is, therefore, among the objects of the present invention to provide a pack which permits the spinning of core/sheath fibers from at least two different molten or dissolved polymers having differing properties, e.g. viscosities. It is also among the objects of this invention to provide such a pack which will produce concentric fibers of this type with precision. It is further among the objects of this invention to provide a device wherein there is a high density of die capillaries per square centimeter of spinneret area under the same production conditions as are currently used for single component fibers. It is still further among the objects of the present invention to provide a device which can be used with existing equipment.

The known basic packs for the production of multicomponent fibers are arranged side-by-side and consist of a distributor and a spinneret plate (as described in Swiss Patent No. 454,344. The fibers are spun from molten or dissolved materials, preferably synthetic polymers, and have cross sectional structures formed from at least two polymers having different properties. In accordance with the present invention, a thin separating plate is located between the distributor and the spinneret plate and the polymers used are guided through the separating plate in independent streams. Thereafter, the streams enter the exit channel in the spinneret plate which may have an enlarged entry diameter at its upstream end.

The laminar streams do not mix and the composite core/sheath fiber is produced when the streams exit the spinneret plate through the die capillary. The die openings are frequently circular, but need not be so. The fiber can be hollow if desired; one way of producing this is to make the core in a hollow form having a diameter smaller than that of the annulus.

DETAILED DESCRIPTION OF THE INVENTION

The present invention comprises a pack for spinning core/sheath fibers from the plurality of fiber-forming materials. The pack broadly includes a spinneret plate, a separating plate superposed thereon, and a distributor located on the separating plate. The distributor has a first conduit which receives a first polymeric material and a second conduit which receives a second polymeric material. These materials are conveyed by their respective conduits in first and second streams to the separating plate.

This plate comprises the core cavity and an annulus surrounding it for each fiber. There is a sheath channel which fluidly connects the first conduit with the annulus and a core channel correspondingly which fluidly connects the second conduit and the core cavity.

Thus, the two streams flow through the separating plate to the spinneret plate. The latter contains an exit channel which leads to the die capillary at the downstream end thereof. The annulus and core cavity feed into this channel so that the streams are joined at this point, but do not mix. As previously indicated, the entry diameter of the exit channel must be at least as large as the diameter of the annulus. One diameter must not overlap the other one. It is, of course, preferable that the entry diameter be larger than the diameter of the annulus in order to allow for variations in the alignment of the plates. It is also preferred that the exit channel have an intermediate section which has a diameter smaller than the entry diameter, but larger than the diameter of the die capillary.

BRIEF DESCRIPTION OF THE DRAWINGS

In the accompanying drawings, constituting a part hereof, in which like reference characters indicate like parts.

FIG. 10 is a cross section of a separating plate and the tool used to produce the annular channel; and FIGS. 11 to 14 are schematic plan views of various embodiments of separating plates.

Figure 1:
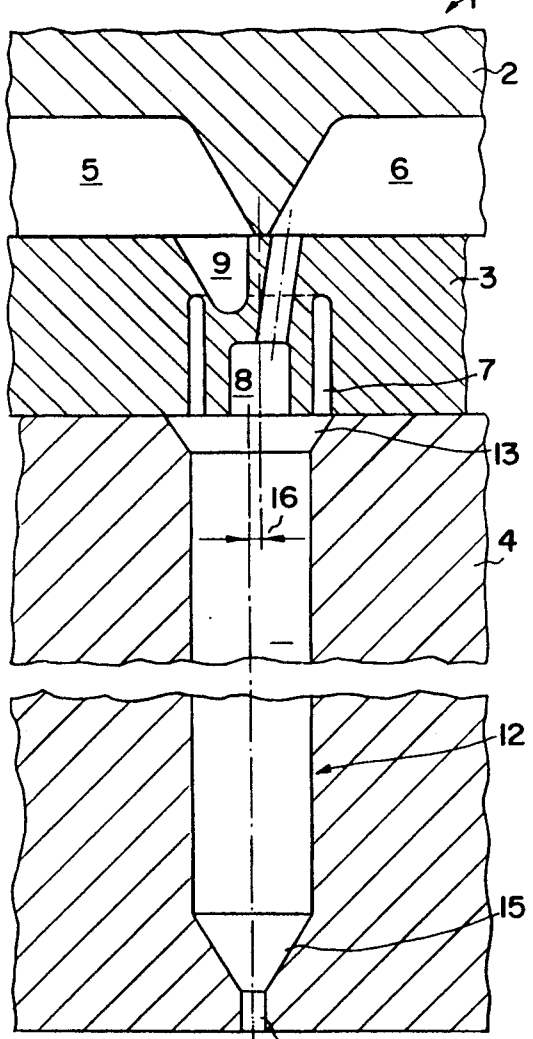
FIG. 1 is a section through the first embodiment of the pack of the present invention.

Referring first to FIG. 1, there is provided pack 1 comprising distributor 2, separating plate 3, and spinneret plate 4. Distributor 2 consists of sheath feed 5 and core feed 6. Separating plate 3 is provided with sheath channel 9 which, at its upper end, is open to sheath feed 5 and, at its lower end, is connected to annulus 7. Correspondingly, core channel 10 connects core feed 6 with core cavity 8.

Spinneret plate 4 contains exit channel 12 which comprises entry 13, section 14, and die capillary 11. As can be seen in FIG. 1, the diameter of entry 13 is greater than that of any portion of exit channel 12 and also exceeds the outside diameter of annulus 7. The latter is an important feature of the present invention, since it permits substantial inaccuracy in the alignment of separating plate 3 (and hence annulus 7 and core cavity 8) and spinneret plate 4. Thus, even though separating plate 3 is out of alignment with spinneret plate 4 by an amount 16, the diameter of entry 13 is sufficient to receive the entire polymer stream from annulus 7. Its constant width preserves the concentricity of the finished product. Moreover, this configuration can even accept non concentricity of core cavity 8 and annulus 7.

In operation, a first polymeric material is fed into sheath feed 5 and a second polymeric material is fed into core feed 6. The streams formed thereby are conveyed through sheath channel 9 and core channel 10 to the annulus 7 and core cavity 8, respectively. They exit therefrom into entry 13 of exit channel 12, flow through wide section 14 and are extruded from die capillary 11.

The misalignment which has been shown in FIG. 1 is equally applicable to all embodiments of the present invention. However, for simplicity, this has not been illustrated in any of the remaining figures.

Figure 2:
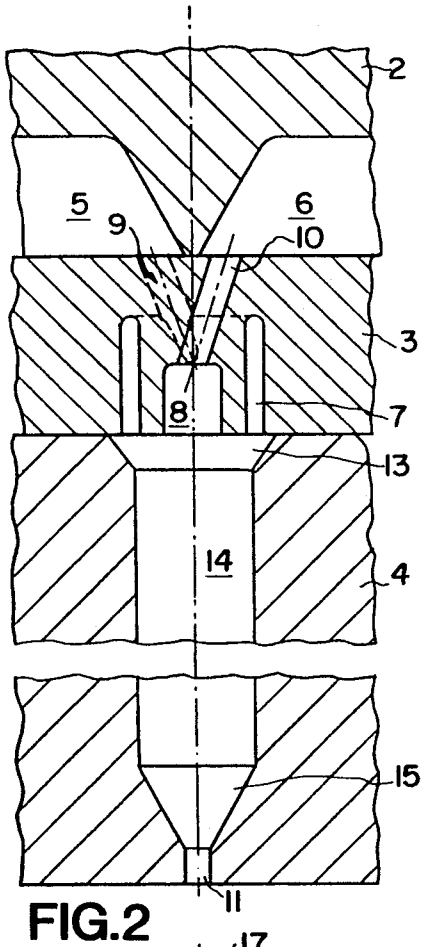
FIGS. 2, 4, 6, & 8 are views similar to that of FIG. 1 showing additional embodiments of the present invention.
Figure 3:
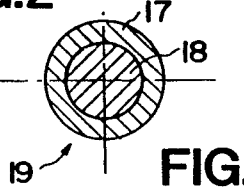
FIGS. 3, 5, 7, & 9 are cross sections of fibers produced by the packs of FIGS. 2, 4, 6, and 8, respectively.

FIG. 2 shows a second embodiment of the present invention. It is substantially similar to that of FIG. 1, except that there are two sheath channels 9, whereby the material in sheath feed 5 is conveyed to annulus 7 at two points, preferably diametrically opposite each other. This can be used to effect superior flow in annulus 7 if desired. Otherwise, it is the same as the first embodiment. Fiber 19 (see FIG. 3), which is produced by the packs of FIGS. 1 or 2, comprises sheath 17 and core 18.

Figure 4:
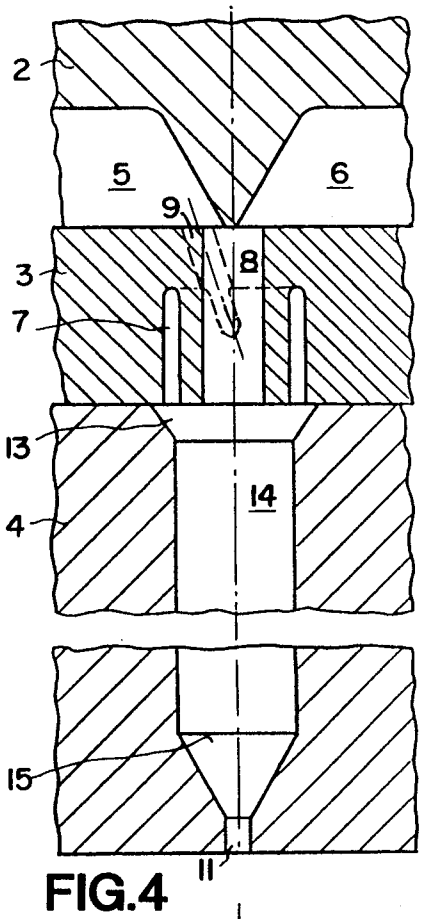
Figure 5:
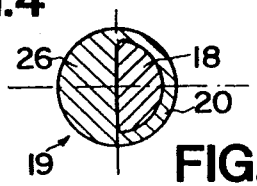

A third embodiment is shown in FIG. 4. It is substantially the same as the previous embodiments except that core cavity 8 extends through the entire thickness of separating plate 3 and both sheath feed 5 and core feed 6 are open thereto. Thus, fiber 19 (see FIG. 5), which is produced by this embodiment, comprises solid portion 26, core 18, and arc 20. In essence, core 18 is of semi-circular cross section, and fiber 19 is really half solid fiber and half core/sheath fiber.

Figures 6, 7, 8, 9:
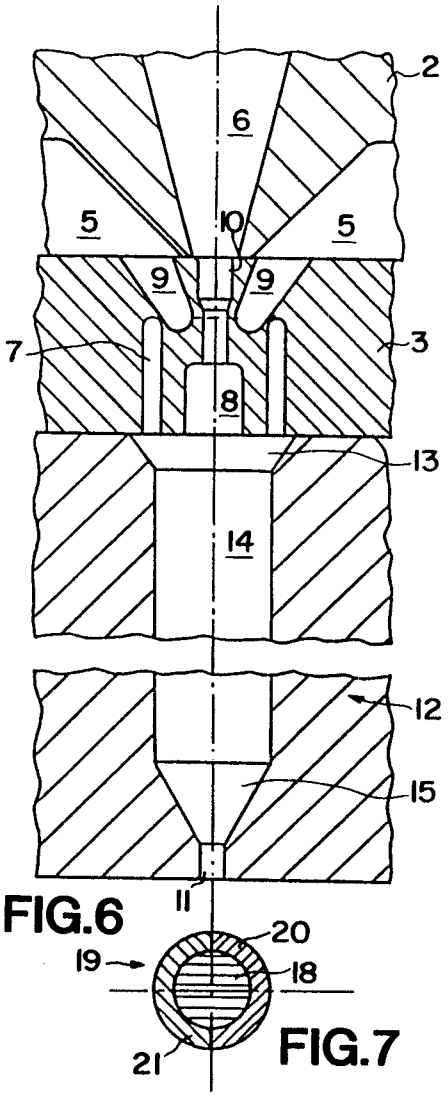

A fourth embodiment of the present invention is shown in FIG. 6. In this embodiment, there are two sheath feeds 5 and a single core feed 6. This permits the formation of fiber 19 (FIG. 7) wherein sheath 17 comprises first arc 20 and second arc 21 of different materials. A fifth embodiment, which is essentially a reversal of the fourth embodiment, is shown in FIG. 8. Here, there are two core feeds 6 and a single sheath feed 5. As is shown in FIG. 9, fiber 19 resulting therefrom comprises sheath 17 and a core composed of first semi-circle 22 and second semi-circle 23. These can be of different materials.

The preferred method of producing separating plate 3 is shown in FIG. 10. Rotary tool 24 is provided with teeth 25. These grind out annulus 7 in separating plate 3. As a result, annulus 7 is of constant thickness throughout its periphery and variation thereof (which is greatly to be avoided) is substantially eliminated.

FIG. 11 is directed to the embodiment of Figure 6. Sheath channels 9, core channel 10, as well as annulus 7 and core cavity 8 are all visible. FIG. 12 is the corresponding view of separating plate 3 of FIG. 2, FIG. 13 corresponds to FIG. 1, and FIG. 14 shows the embodiment of FIG. 8.

One of the advantages of the present invention is that it permits the easy conversion of existing side-by-side packs to those of the present invention. It is only necessary to disassemble the distributor and spinneret plate, insert the separating plate of the present invention, and reassemble the pack.

In producing the separating plate of the present invention, it has been found advantageous to use a rotary tool in order to cut the annulus. The specific method of accomplishing this is not critical, although the use of a toothed tool or an erosion electrode has been found satisfactory. Due to the rotary method of manufacturing, the annulus is precisely concentric with the core cavity and is of constant thickness around its entire periphery.

Because of the foregoing accuracy, it is possible to produce fibers with very precise concentric cross sections, even though there are variations in spacing resulting from unavoidable manufacturing tolerances. Moreover, the die capillaries can be located much closer together than would be possible using the packs of the prior art. In addition, the precision possible with the present invention eliminates or minimizes the undesirable kneeling of the spun fibers as they exit the die capillary. Finally, the present invention is able to achieve higher throughputs (even exceeding two kilograms per minute) while maintaining excellent quality.

As a result of substantial experimentation with the present device, a number of phenomena were observed. The centering of the core is substantially dependent on the constancy of the width of the annular channel. Therefore, precise alignment of the core and sheath producing elements of the pack is not necessary. It is only required that no portion of the annulus be outside the entry portion of the exit channel in the spinneret plate. Thus, if this portion of the exit channel has a diameter substantially larger than that of the annulus, considerable variation can be tolerated without impairing the concentricity of the finished product.

As a matter of fact, even eccentricity of core channel inside the annulus does not affect the cross section of the fiber, provided only that the channel walls do not intercept. In similar fashion, the type and position of the entrance of the channels does not, within wide limits, affect the fiber cross section. Thus, the closeness of the die capillaries is limited only by the diameter of the exit channel and the requirements for strength of the elements of the pack. The remaining portions of the present invention require virtually no space which extends beyond the enlarged entry diameter of the exit channel; as a result, it is possible to achieve in excess of ten die capillaries per square centimeter of spinneret plate.

The present invention avoids small delicate parts, and provides compact components wherein the various channels needed to shape the fiber cross section are within the device, so that no vulnerable parts project therefrom. Moreover, the components are planar and are superposed so that no complex interconnections are required. Simple locating pins and complementary bores are satisfactory for this purpose. As a result of the foregoing, the devices of the present invention are strong and can withstand the necessary dismantling, cleaning, and reassembly.

In summary, the device of the present invention provides great flexibility in installation, removal, and use. For example, a hollow fiber may be produced by simply making the core annular in a hollow form. Such other and further modifications of the present invention may be made without departing from the scope or spirit thereof. Although only a limited number of specific embodiments of the present invention have been expressly described, it is, nonetheless, to be broadly construed and not to be limited except by the character of the claims appended hereto.

I claim:

1. A pack for spinning core/sheath fiber from a plurality of fiber-forming materials, said pack comprising a distributor, a spinneret plate and a separating plate therebetween, said distributor having, for each fiber, at least one first chamber for supplying at least one sheath material, at least one second chamber for supplying at least one core material, at least one first conduit and at least one second conduit, said first conduit being adapted to convey said sheath material from said at least one first chamber in a downstream direction, said second conduit being adapted to convey said core material from said at least one second chamber in said downstream direction, said separating plate comprising, for each fiber, a single core cavity and an annulus of constant width, said annulus having an annular diameter and surrounding said core cavity, a sheath channel fluidly connecting said first conduit to said annulus whereby said sheath material is supplied to said annulus substantially around the entire circumference thereof, said sheath material being transported through said annulus to form a fiber sheath; a core channel fluidly connecting said second conduit to said single core cavity, whereby said core material is transported through said core cavity to form a single fiber core, said spinneret plate comprising, for each fiber, an exit channel having a die capillary at a downstream end, said exit channel being fluidly connected to said annulus and said core cavity at an upstream end of said exit channel said exit channel having an entry portion at said upstream end, said entry portion having an entry diameter greater than said annular diameter, and said die capillary having a die diameter, whereby said sheath formed by said annulus and said core formed by said core channel are co-extruded through said die capillary to form said core/sheath fiber.

2. The pack of claim 1 wherein said exit channel further comprises a section having a section diameter smaller than said entry diameter, larger than said die diameter, and located between said upstream end and said die capillary.

3. The pack of claim 1 wherein said die capillary is non-circular.

4. The pack of claim 1 wherein said die capillary is substantially circular.

5. The pack of claim 1 wherein there are at least 10 said die capillaries per square centimeter.

6. The pack of claim 1 wherein said separating plate further comprises at least one locating pin normal to said separating plate with a complementary recess in said distributor adapted to receive said pin, whereby said separating plate is secured to said distributor.

7. The pack of claim 1 wherein said distributor further comprises at least one locating pin normal to said distributor with a complementary recess in said separating plate adapted to receive said pin, whereby said separating plate is secured to said distributor.

* * * * *